US012222174B2

(12) United States Patent
Norén

(10) Patent No.: US 12,222,174 B2
(45) Date of Patent: Feb. 11, 2025

(54) HEAT TRANSFER PLATE WITH HEAT TRANSFER RIDGES HAVING VARYING WIDTH

(71) Applicant: ALFA LAVAL CORPORATE AB, Lund (SE)

(72) Inventor: Mattias Norén, Oxie (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 17/769,463

(22) PCT Filed: Nov. 4, 2020

(86) PCT No.: PCT/EP2020/080936
§ 371 (c)(1),
(2) Date: Apr. 15, 2022

(87) PCT Pub. No.: WO2021/104815
PCT Pub. Date: Jun. 3, 2021

(65) Prior Publication Data

US 2023/0160642 A1 May 25, 2023

(30) Foreign Application Priority Data

Nov. 26, 2019 (EP) ..... 19211477

(51) Int. Cl.
*F28F 3/04* (2006.01)
*F28D 9/00* (2006.01)

(52) U.S. Cl.
CPC ..... *F28F 3/042* (2013.01); *F28D 9/0043* (2013.01); *F28F 2250/10* (2013.01)

(58) Field of Classification Search
CPC ..... F28D 9/0037; F28F 3/042
See application file for complete search history.

(56) References Cited

U.S. PATENT DOCUMENTS 3,887,664 A 6/1975 Regehr
4,014,385 A 3/1977 Wright
(Continued)

FOREIGN PATENT DOCUMENTS

CN 103688128 A 3/2014
CN 103791757 A 5/2014
(Continued)

OTHER PUBLICATIONS

Translation of Chinese Patent Document CN107525429A entitled Translation-CN107525429A (Year: 2023).*
(Continued)

*Primary Examiner* — Paul Alvare
(74) *Attorney, Agent, or Firm* — BUCHANAN INGERSOLL & ROONEY PC

(57) ABSTRACT

A heat transfer plate includes a heat transfer area provided with a heat transfer pattern having elongate alternately arranged heat transfer ridges and valleys, a respective top portion of the ridges extending in a top plane and a respective bottom portion of the valleys extending in a bottom plane. The heat transfer ridges include ridge contact areas within which the ridges are arranged to abut an adjacent first heat transfer plate. Within at least half of the heat transfer area, the top portions of the ridges have a first width w1, and the bottom portions of the valleys have a second width w2, w1≠w2. The top portion of a number of first heat transfer ridges of the heat transfer ridges, within a respective first ridge contact area of the ridge contact areas, has a third width w3, wherein, if w1>w2 then w3<w1, and, if w1<w2 then w3>w1.

20 Claims, 7 Drawing Sheets

(56) References Cited

U.S. PATENT DOCUMENTS

| | | | | | |
|---|---|---|---|---|---|
| 4,630,674 | A | | 12/1986 | Skoog | |
| 5,398,751 | A | * | 3/1995 | Blomgren | F28F 3/046 165/166 |
| 5,806,584 | A | | 9/1998 | Thonon et al. | |
| 8,109,326 | B2 | | 2/2012 | Larsson et al. | |
| 8,746,329 | B2 | | 6/2014 | Blomgren et al. | |
| 9,739,542 | B2 | * | 8/2017 | Hedberg | F28F 3/046 |
| 2010/0258284 | A1 | | 10/2010 | Krantz | |
| 2012/0325434 | A1 | * | 12/2012 | Blomgren | F28F 9/026 165/104.19 |
| 2016/0282058 | A1 | * | 9/2016 | Blomgren | F28F 3/083 |
| 2019/0204024 | A1 | | 7/2019 | Hedberg | |
| 2019/0376749 | A1 | * | 12/2019 | Zhang | F28D 9/00 |

FOREIGN PATENT DOCUMENTS

| | | | | | |
|---|---|---|---|---|---|
| CN | 107462093 | A | * | 12/2017 | F28D 9/00 |
| CN | 107525429 | A | * | 12/2017 | |
| CN | 108885074 | A | | 11/2018 | |
| EP | 0014066 | A1 | | 8/1980 | |
| EP | 2 700 894 | A1 | | 2/2014 | |
| EP | 2728292 | A1 | | 5/2014 | |
| EP | 2741041 | A1 | * | 6/2014 | F25B 30/02 |
| EP | 2886997 | A1 | | 6/2015 | |
| EP | 3225947 | A1 | * | 10/2017 | F28D 9/005 |
| GB | 1359954 | A | | 7/1974 | |
| IL | 261690 | | * | 2/2019 | |
| JP | 55-096893 | A | | 7/1980 | |
| JP | S58-096987 | A | | 6/1983 | |
| JP | 2001-280887 | A | | 10/2001 | |
| JP | 3675475 | B2 | | 7/2005 | |
| JP | 2013-527418 | A | | 6/2013 | |
| JP | 5805189 | B2 | | 11/2015 | |
| JP | 2017-500533 | A | | 1/2017 | |
| JP | 2019095124 | A | * | 6/2019 | |
| SE | 531781 | C2 | * | 8/2009 | F28D 9/0037 |
| TW | 201030306 | A | * | 8/2010 | F28D 9/005 |
| TW | I445917 | B | | 7/2014 | |
| TW | 201923301 | A | | 6/2019 | |
| UA | 9612 | U | | 10/2005 | |
| UA | 66835 | U | | 1/2012 | |
| WO | WO-9325860 | A1 | * | 12/1993 | F28D 9/005 |
| WO | 94/19657 | A1 | | 9/1994 | |
| WO | 2011/133087 | A2 | | 10/2011 | |
| WO | 2011162659 | A1 | | 12/2011 | |
| WO | 2012/143998 | A1 | | 10/2012 | |
| WO | 2013/008320 | A1 | | 1/2013 | |
| WO | WO-2017133618 | A1 | * | 8/2017 | F28D 9/00 |
| WO | 2017167598 | A1 | | 10/2017 | |
| WO | 2018197031 | A1 | | 11/2018 | |
| WO | 2019068426 | A1 | | 4/2019 | |

OTHER PUBLICATIONS

Translation of Japanese Patent Document JP2019095124A entitled Translation-JP2019095124A (Year: 2023).*

International Search Report (PCT/ISA/210) and Written Opinion (PCT/ISA/237) mailed on Jan. 11, 2021, by the European Patent Office as the International Searching Authority for International Application No. PCT/EP2020/080936.

Notification of Transmittal of the International Preliminary Report on Patentability (PCT/IPEA/416) and International Preliminary Report on Patentability (PCT/IPEA/409) in corresponding Patent Application No. PCT/EP2020/080936 dated Oct. 21, 2021.

Notice of Allowance (Written Decision on Registration) issued Feb. 7, 2023, by the Korean Intellectual Property Office in corresponding Korean Patent Application No. 10-2022-7021213 and an English translation of the Notice. (7 pages).

Office Action (Notification to Grant Patent Right for Invention) issued Aug. 16, 2022, by the National Intellectual Property Administration, P. R. China in corresponding Chinese Patent Application No. 202080081714.3 and an English Translation of the Office Action. (6 pages).

Notice of Allowance (Decision to Grant a Patent) issued Dec. 23, 2022, by the Japan Patent Office in corresponding Japanese Patent Application No. 2022-530970 and an English translation of the Notice. (5 pages).

Decision to Grant a Patent issued by the Ukrainian Patent Office on Feb. 15, 2024, in corresponding Ukrainian Patent Application No. 2022 02144 and partial English translation of the Decision. (8 pages).

* cited by examiner

HEAT TRANSFER PLATE WITH HEAT TRANSFER RIDGES HAVING VARYING WIDTH

TECHNICAL FIELD

The invention relates to a heat transfer plate and its design.

BACKGROUND ART

Plate heat exchangers may typically consist of two end plates in between which a number of heat transfer plates are arranged in an aligned manner, i.e. in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other.

In one type of well-known PHEs, the so called gasketed PHEs, gaskets are arranged between the heat transfer plates. The end plates, and therefore the heat transfer plates, are pressed towards each other by some kind of tightening means, whereby the gaskets seal between the heat transfer plates. Parallel flow channels are formed between the heat transfer plates, one channel between each pair of adjacent heat transfer plates. Two fluids of initially different temperatures, which are fed to/from the PHE through inlets/outlets, can flow alternately through every second channel for transferring heat from one fluid to the other, which fluids enter/exit the channels through inlet/outlet port holes in the heat transfer plates communicating with the inlets/outlets of the PHE.

Typically, a heat transfer plate comprises two end portions and an intermediate heat transfer portion. The end portions comprise the inlet and outlet port holes and distribution areas pressed with a distribution pattern of ridges and valleys. Similarly, the heat transfer portion comprises a heat transfer area pressed with a heat transfer pattern of ridges and valleys. The ridges and valleys of the distribution and heat transfer patterns of the heat transfer plate is arranged to contact, in contact areas, the ridges and valleys of distribution and heat transfer patterns of adjacent heat transfer plates in a plate heat exchanger. The main task of the distribution areas of the heat transfer plates is to spread a fluid entering the channel across the width of the heat transfer plates before the fluid reaches the heat transfer areas, and to collect the fluid and guide it out of the channel after it has passed the heat transfer areas. On the contrary, the main task of the heat transfer area is heat transfer.

Since the distribution areas and the heat transfer area have different main tasks, the distribution pattern normally differs from the heat transfer pattern. The distribution pattern may be such that it offers a relatively weak flow resistance and low pressure drop which is typically associated with a more "open" pattern design, such as a so-called chocolate pattern, offering relatively few, but large, contact areas between adjacent heat transfer plates. The heat transfer pattern may be such that it offers a relatively strong flow resistance and high pressure drop which is typically associated with a more "dense" pattern design, such as a so-called herringbone pattern, offering more, but smaller, contact areas between adjacent heat transfer plates.

In many applications, the flows of the two fluids to be fed through the PHE are different, and/or the physical characteristics of the two fluids are different, which for optimum heat transfer may require that the channels for receiving one of the fluids have different characteristics than the channels for receiving the other one of the fluids. In other applications, it is preferred to have similar characteristics for all channels. Known on the market are heat transfer plates provided with so-called asymmetric heat transfer patterns which, depending on how they are stacked in relation to each other, can provide different types of channels. FIGS. 1*a* and 1*b* each illustrate four heat transfer plates 1 comprising a heat transfer pattern which is asymmetric in that the ridges 3 are wider than the valleys 5. In FIG. 1*a* the heat transfer plates 1 are "flipped" in relation to each other such that the ridges 3 of the heat transfer plates 1 abut each other in contact areas, while the valleys 5 of the heat transfer plates 1 abut each other in contact areas. As is clear from FIG. 1*a*, such plate "flipping" creates channels of different characteristics, more particularly different volumes. In FIG. 1*b* the heat transfer plates 1 are "rotated" in relation to each other such that the ridges 3 and valleys 5 of one heat transfer plate abut, in contact areas, the valleys 5 and ridges 3, respectively, of the adjacent heat transfer plates 1. As is clear from FIG. 1*b*, such plate "rotation" creates channels of similar characteristics, more particularly similar volumes.

Even if the heat transfer plates 1 illustrated in FIGS. 1*a* and 1*b* can be used to, in a straightforward way, create different types of channels depending on how the plates are orientated in relation to each other, plate deformation may occur in the contact areas, especially in the rotation case illustrated in FIG. 1*b* where the more narrow valleys 5 abut the wider ridges 3. During compression of a plate pack comprising the heat transfer plates 1 of FIG. 1*b*, the valleys 5 may "cut into" and deform the ridges 3. This unnecessarily limits the pressure performance of the heat transfer plates.

SUMMARY

An object of the present invention is to provide a heat transfer plate which at least partly solves the above discussed problem of prior art. The basic concept of the invention is to locally change the heat transfer pattern of the heat transfer plate which may reduce the difference between the width of the bottom portions of the valleys and the width of the top portions of the ridges. The heat transfer plate, which is also referred to herein as just "plate", for achieving the object above is defined in the appended claims and discussed below.

A heat transfer plate according to the invention is arranged to be comprised in a plate heat exchanger. It comprises a first distribution area, a heat transfer area and a second distribution area arranged in succession along a longitudinal center axis of the heat transfer plate. The longitudinal center axis extends perpendicular to a transverse center axis of the heat transfer plate. The heat transfer area is provided with a heat transfer pattern differing from a pattern within the first and second distribution areas. The first distribution area adjoins the heat transfer area along an upper borderline. Similarly, the second distribution area adjoins the heat transfer area along a lower borderline. The heat transfer pattern comprises elongate alternately arranged heat transfer ridges and heat transfer valleys. A respective top portion of the heat transfer ridges extends in a top plane, and a respective bottom portion of the heat transfer valleys extends in a bottom plane. The top and bottom planes are parallel to each other. A center plane extending half-way between, and parallel to, the top and bottom planes defines a border between the heat transfer ridges and the heat transfer valleys. The heat transfer ridges comprise ridge contact areas within which the heat transfer ridges are arranged to abut an adjacent first heat transfer plate in the plate heat exchanger. Similarly, the heat transfer valleys comprise valley contact areas within which the heat transfer valleys are arranged to abut an adjacent second heat transfer plate in the plate heat exchanger. Within at least half of the heat transfer area, the top portions of the heat transfer ridges have a first width w1, and the bottom portions of the heat transfer valleys have a second width w2. A width of the top and bottom portions is measured perpendicular to a longitudinal extension of the heat transfer ridges and heat transfer valleys, and w1≠w2. The heat transfer plate is characterized in that the top portion of a number of first heat transfer ridges of the heat transfer ridges, within a respective first ridge contact area of the ridge contact areas, has a third width w3. If w1>w2, then w3<w1, and if w1<w2, then w3>w1.

The heat transfer ridges project upwards from the center plane, and the heat transfer valleys descend downwards from the center plane, when the plate lies, with a specific reference orientation, on a flat surface. Of course, when the plate is in use in a plate heat exchanger, the heat transfer ridges need not project upwards, but could instead, for example, point downwards or to the side. Similarly, when the plate is in use in a plate heat exchanger, the heat transfer valleys need not descend downwards, but could instead, for example, point upwards or to the side. Naturally, the heat transfer ridges and valleys when the plate is viewed from one side, are heat transfer valleys and ridges, respectively, when the plate is viewed from the opposite side. A corresponding reasoning is valid for the upper and lower borderlines. The lower borderline may be arranged above the upper borderline depending on the orientation of the heat transfer plate.

The top, bottom and center planes are imaginary.

The top portion of a heat transfer ridge is the portion of the heat transfer ridge extending in the top plane. Similarly, the bottom portion of a heat transfer valley is the portion of the heat transfer valley extending in the bottom plane.

The number of first heat transfer ridges, and the number of first ridge contact areas per first heat transfer ridge, may be one or more.

The heat transfer plate may, or my not, be of the same type as one or both of the first and second heat transfer plates.

Herein, when talking about widths of the top and bottom portions, the widths of complete top and bottom portions are referred to, if nothing else is said. For example, at ends of the heat transfer ridges and heat transfer valleys, the top and bottom portions may be beveled and not complete if the heat transfer ridges and heat transfer valleys extend oblique with respect to the longitudinal center axis of the heat transfer plate, which is typically the case.

In that the top portions of the heat transfer ridges have a width that is different from the width of the bottom portions of the heat transfer valleys within at least half of the heat transfer area, the heat transfer plate is asymmetric with respect to the center plane within at least half of the heat transfer area. Within the first ridge contact areas of the first heat transfer ridges, the width of the top portion is increased or decreased so as to get closer, or even equal, to the width of the bottom portion of the heat transfer valleys within said at least half of the heat transfer area. Thereby, when the heat transfer plate is brought into abutment with another heat transfer plate according to the present invention, the contact areas of the two heat transfer plates may locally be more of the same size than would have been the case without the local change of the top portion width within the first ridge contact areas. Consequently, the risk of one of the heat transfer plates "cutting into" the other one of the heat transfer plates may be reduced.

The heat transfer ridges and heat transfer valleys may be straight. Further, heat transfer ridges and heat transfer valleys may extend obliquely in relation to the transverse center axis of the heat transfer plate. Furthermore, the heat transfer ridges and heat transfer valleys may form V-shaped corrugations. The apices of these V-shaped corrugations may be arranged along the longitudinal centre axis of the heat transfer plate.

The first and second widths w1 and w2 may be constants.

The heat transfer plate may further comprise an outer edge portion enclosing the first and second distribution areas and the heat transfer area. The outer edge portion may comprise corrugations extending between and in the top and bottom planes. The complete outer edge portion, or only one or more portions thereof, may comprise corrugations. The corrugations may be evenly or unevenly distributed along the edge portion, and they may, or may not, all look the same. The corrugations may define ridges and valleys which may give the edge portion a wave-like design.

The heat transfer plate may further comprise a gasket groove arranged to receive a gasket. Along two opposing long sides of the heat transfer area the gasket groove may border on, or limit, the heat transfer area and extend between the heat transfer area and the outer edge portion.

The heat transfer plate may be such that w3≥w2 if w1>w2, which means that the top portion width within the first ridge contact areas is decreased but maintained not smaller than the bottom portion width within said at least half of the heat transfer area. On the contrary, the heat transfer plate may be such that w3≤w2 if w1<w2, which means that the top portion width within the first ridge contact areas is increased but maintained not larger than the bottom portion width within said at least half of the heat transfer area. If w3=w2, the top portion width within the first ridge contact areas is increased or decreased so as to get equal to the width of the bottom portion of the heat transfer valleys within said at least half of the heat transfer area. This may, when the heat transfer plate is brought into abutment with another heat transfer plate according to the present invention, minimize the risk of one of the heat transfer plates "cutting into" the other one of the heat transfer plates.

The heat transfer plate may be such that, with reference to a cross section through, and perpendicular to the longitudinal extension of, the heat transfer ridges and heat transfer valleys, the first heat transfer ridges, within the first ridge contact areas, and the heat transfer valleys within said at least half of the heat transfer area, are symmetrical with respect to said center plane. This embodiment may make the generally asymmetric heat transfer plate locally symmetric. In turn this may, when the heat transfer plate is brought into abutment with another heat transfer plate according to the present invention, minimize the risk of the heat transfer plates deforming each other.

The heat transfer plate may be so designed that w1>w2, i.e. so that the the top portions of the heat transfer ridges are wider than the bottom portions of the heat transfer valleys within at least half of the heat transfer area. Further, the bottom portion of a number of first heat transfer valleys of the heat transfer valleys, may, within a respective first valley contact area of the valley contact areas, have a fourth width w4, wherein w2<w4. Thereby, the width of the top portion is decreased within the first ridge contact areas of the first heat transfer ridges, while the width of the bottom portion is increased within the first valley contact areas of the first heat transfer valleys. This may enable smaller variations in the width of the top portions of the heat transfer ridges, as compared to if only the top portion width is locally changed, which may improve the strength of the heat transfer plate and facilitate manufacturing of the heat transfer plate.

The number of first heat transfer valleys, and the number of first valley contact areas per first heat transfer valley, may be one or more.

When w1>w2 the heat transfer plate may be such that w4≤w3, which means that the top portion width is maintained not smaller than the bottom portion width within the complete heat transfer area. If w4=w3 the width of the top portion within the first ridge contact areas of the first heat transfer ridges is equal to the width of the bottom portion within the first valley contact areas of the first heat transfer valleys. This may, when the heat transfer plate is brought into abutment with another heat transfer plate according to the present invention, minimize the risk of one of the heat transfer plates "cutting into" the other one of the heat transfer plates.

With reference to a cross section through, and perpendicular to the longitudinal extension of, the heat transfer ridges and heat transfer valleys, the first heat transfer ridges, within the first ridge contact areas, and the first heat transfer valleys, within the first valley contact areas, may be symmetrical with respect to said center plane. This embodiment may make the generally asymmetric heat transfer plate locally symmetric. In turn this may, when the heat transfer plate is brought into abutment with another heat transfer plate according to the present invention, minimize the risk of the heat transfer plates deforming each other.

In line with previous discussions, the first and second distribution areas are typically provided with a pattern offering few, but large, contact areas between adjacent heat transfer plates, while the heat transfer area typically is provided with a pattern offering more, but smaller, contact areas between adjacent heat transfer plates. Thus, the distance between adjacent contact areas within the first and second distribution areas may typically be larger than the distance between adjacent contact areas within the heat transfer area. A pack of aligned heat transfer plates is typically weaker where the distance between adjacent contact areas is relatively large. Further, at the transition between the distribution and heat transfer areas, i.e. where the plate pattern changes, the contact areas are typically relatively scattered which may negatively impact the strength of the heat transfer plate pack at the transition. Where the plate pack is less strong, it is more prone to deformation which could result in malfunctioning of the plate heat exchanger.

Accordingly, since the heat transfer plate may be the most prone to deformation close to the first and second distribution areas, each of the first heat transfer valleys may extend from one of said upper and lower borderlines.

Analogously, for each of the first heat transfer valleys, the first valley contact area may be the valley contact area arranged closest to said one of said upper and lower borderlines, since plate deformation is most likely to occur here. Naturally, in case a first heat transfer valley comprises one valley contact area only, this is the one referred to in this context.

In line with the above, the first valley contact areas may be comprised in a respective end portion of the first heat transfer valleys, which end portion extends from said one of said upper and lower borderlines and has a constant width within the bottom portion. Such an embodiment may facilitate the design and manufacturing of the heat transfer plate.

The heat transfer plate may be so constructed that an absolute position, with respect to the longitudinal and transverse center axes of the heat transfer plate, of a respective one of the first ridge contact areas arranged within an upper right quarter, upper left quarter, lower right quarter, and lower left quarter, respectively, of the heat transfer plate, is at least partly overlapping with an absolute position, with respect to the longitudinal and transverse center axes of the heat transfer plate, of a respective one of the first valley contact areas arranged within a lower left quarter, lower right quarter, upper left quarter and upper right quarter, respectively, of the heat transfer plate. The longitudinal and transverse center axes divide the heat transfer plate into four quarters. "Upper right", "lower left", etc. are attributes used only to define the quarters of the heat transfer plate when arranged in a specific reference direction and put no limitations as regards the orientation of the heat transfer plate when arranged in a plate heat exchanger. By absolute position is meant a position a certain distance from the longitudinal and transverse axes in any direction from the axes, i.e. on either side of the axes. When the heat transfer plate according to this embodiment is brought into abutment with another "rotated" overhead heat transfer plate according to this embodiment, said respective one of the first ridge contact areas arranged within the upper right quarter, upper left quarter, lower right quarter, and lower left quarter, respectively, of the heat transfer plate may abut a respective one of the first valley contact areas arranged within the lower left quarter, lower right quarter, upper left quarter and upper right quarter, respectively, of the overhead heat transfer plate. Similarly, when the heat transfer plate according to this embodiment is brought into abutment with another "rotated" underlying heat transfer plate according to this embodiment, said respective one of the first valley contact areas arranged within the upper right quarter, upper left quarter, lower right quarter, and lower left quarter, respectively, of the heat transfer plate may abut a respective one of the first ridge contact areas arranged within the lower left quarter, lower right quarter, upper left quarter and upper right quarter, respectively, of the underlying heat transfer plate.

The heat transfer plate may be so constructed that a mirroring, across the transverse center axis of the heat transfer plate, of a position of one of the first valley contact areas arranged within an upper half of the heat transfer plate, is at least partly overlapping with a position of one of the first valley contact areas arranged within a lower half of the heat transfer plate. When the heat transfer plate according to this embodiment is brought into abutment with another "flipped" underlying heat transfer plate according to this embodiment, said one of the first valley contact areas arranged within the upper half of the heat transfer plate may abut one of the first valley contact areas arranged within the lower half of the underlying heat transfer plate. Further, said one of the first valley contact areas arranged within the lower half of the heat transfer plate may abut one of the first valley contact areas arranged within the upper half of the underlying heat transfer plate.

Analogously, the heat transfer plate may be so constructed that a mirroring, across the transverse center axis of the heat transfer plate, of a position of one of the first ridge contact areas arranged within an upper half of the heat transfer plate, is at least partly overlapping with a position of one of the first ridge contact areas arranged within a lower half of the heat transfer plate. When the heat transfer plate according to this embodiment is brought into abutment with another "flipped" overhead heat transfer plate according to this embodiment, said one of the first ridge contact areas arranged within the upper half of the heat transfer plate may abut one of the first ridge contact areas arranged within the lower half of the overhead heat transfer plate. Further, said one of the first ridge contact areas arranged within the lower half of the heat transfer plate may abut one of the first ridge contact areas arranged within the upper half of the overhead heat transfer plate.

As discussed above, since the heat transfer plate may be the most prone to deformation close to the first and second distribution areas, each of the first heat transfer ridges may extend from one of said upper and lower borderlines.

Analogously, for each of the first heat transfer ridges, the first ridge contact area may be the ridge contact area arranged closest to said one of said upper and lower borderlines, since plate deformation is most likely to occur here. Naturally, in case a first heat transfer ridge comprises one ridge contact area only, this is the one referred to in this context.

In line with the above, the first ridge contact areas may be comprised in a respective end portion of the first heat transfer ridges, which end portion extends from said one of said upper and lower borderlines and has a constant width within the top portion. Such an embodiment may facilitate the design and manufacturing of the heat transfer plate.

The upper and lower borderlines may be non-straight, i.e. extend non-perpendicularly to the longitudinal center axis. Thereby, the bending strength of the heat transfer plate may be increased as compared to if the upper and lower borderlines instead were straight in which case the upper and lower borderlines could serve as bending lines of the heat transfer plate.

The upper and lower borderlines may be curved or arched or convex so as to bulge out towards the heat transfer area. Such curved upper and lower borderlines are longer than corresponding straight upper and lower borderlines would be, which results in a larger "outlet" and a larger "inlet" of the distribution areas. In turn, this contributes to the distribution of fluid across the width of the heat transfer plate and the collection of fluid having passed the heat transfer area. Thereby, the distribution areas can be made smaller with maintained distribution and collection efficiency.

It should be stressed that the advantages of most, if not all, of the above discussed features of the inventive heat transfer plate appear when the heat transfer plate is combined with other suitably constructed heat transfer plates in a plate pack.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which FIG. 1*a* schematically illustrates channels formed between prior art heat transfer plates when stacked in a first way, FIG. 1*b* schematically illustrates channels formed between the heat transfer plates of FIG. 1*a* when stacked in a second way.

DETAILED DESCRIPTION

Figure 1A:
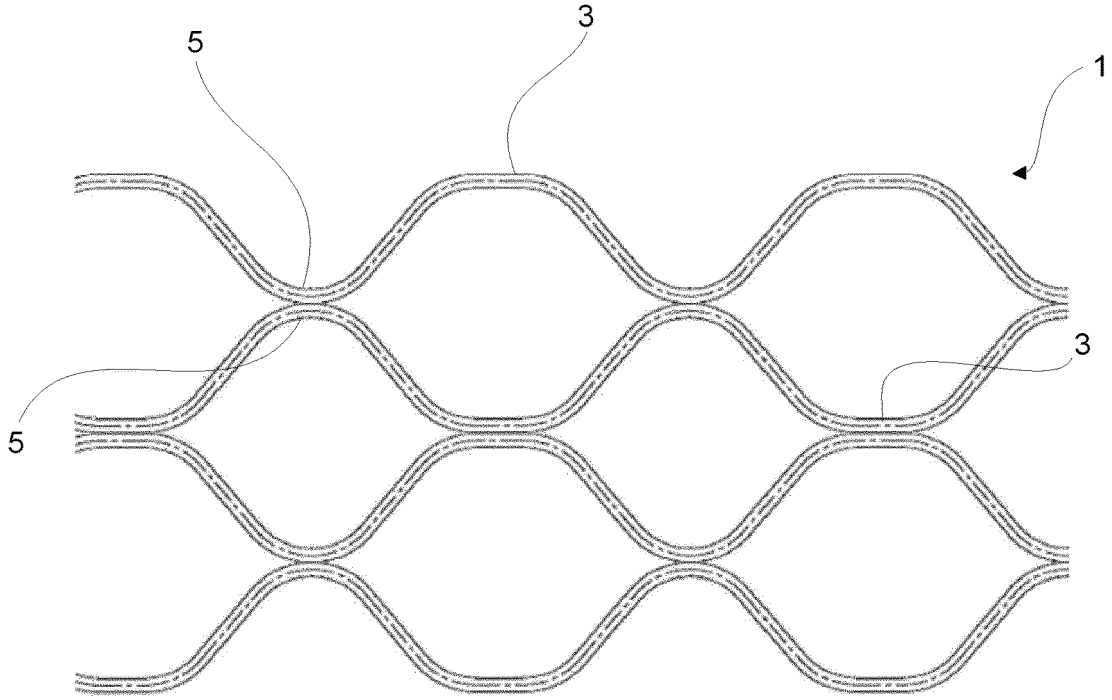
Figure 1B:
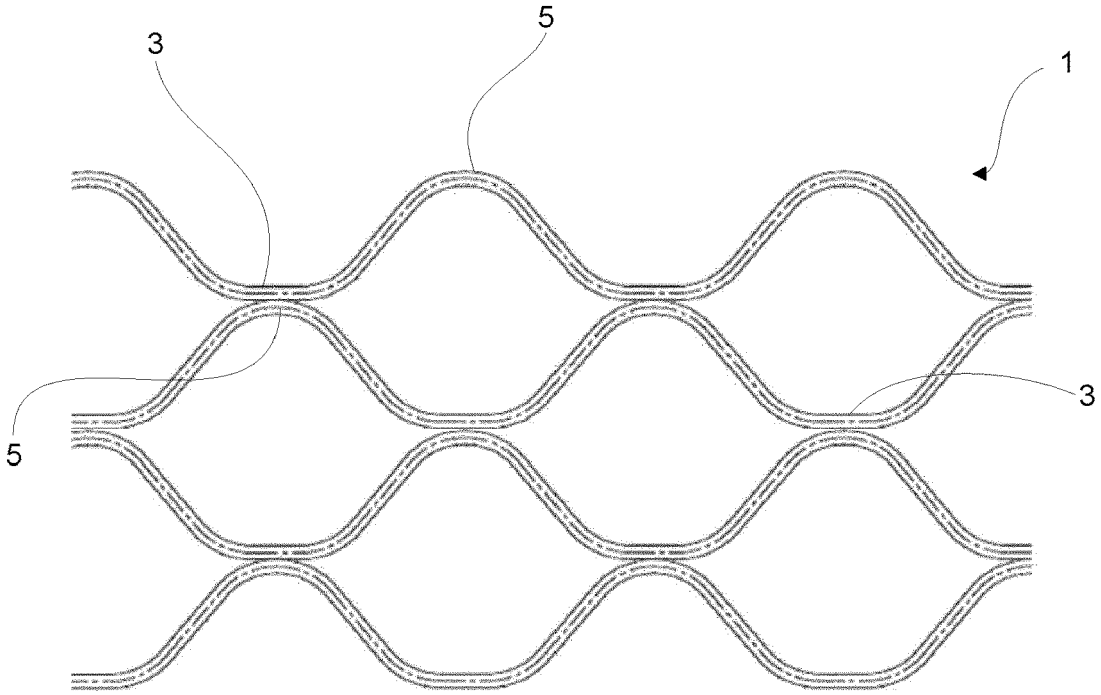
Figure 2:
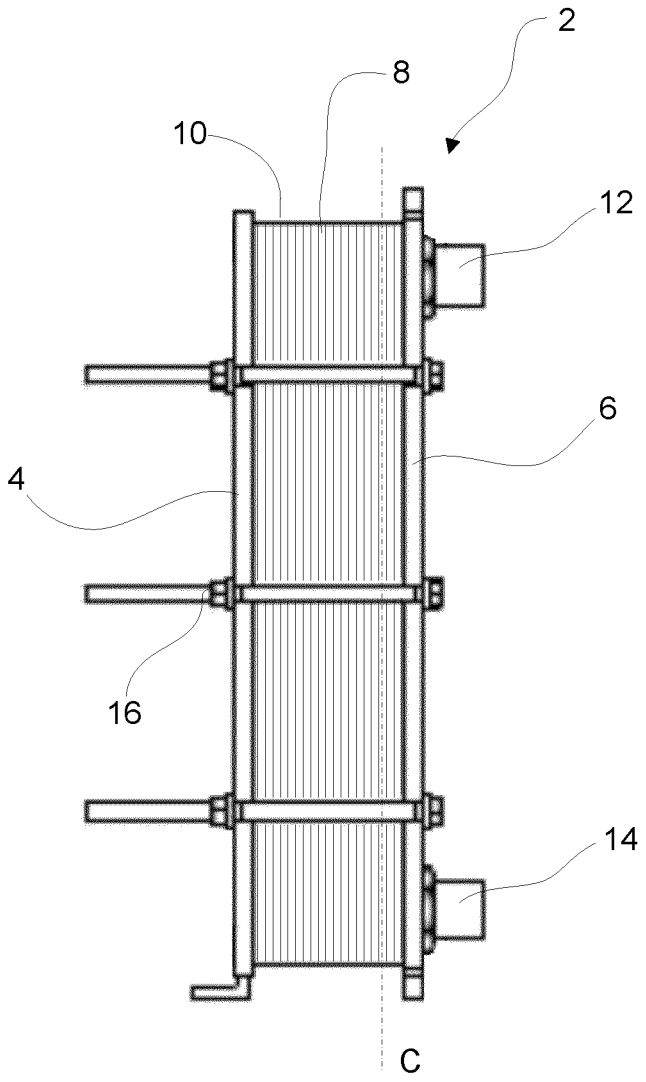
FIG. 2 is a schematic side view of a plate heat exchanger

With reference to FIG. 2, a gasketed plate heat exchanger 2 is shown. It comprises a first end plate 4, a second end plate 6 and a number of heat transfer plates, one of them denoted 8, arranged in a plate pack 10 between the first and second end plates 4 and 6, respectively. The heat transfer plates are all of the same type and "rotated" in relation to each other.

The heat transfer plates are separated from each other by gaskets (not shown). The heat transfer plates together with the gaskets form parallel channels arranged to alternately receive two fluids or media for transferring heat from one fluid or medium to the other. To this end, a first fluid is arranged to flow in every second channel and a second fluid is arranged to flow in the remaining channels. The first fluid enters and exits the plate heat exchanger 2 through an inlet 12 and an outlet 14, respectively. Similarly, the second fluid enters and exits the plate heat exchanger 2 through an inlet and an outlet (not visible in the figures), respectively. For the channels to be leak proof, the heat transfer plates must be pressed against each other whereby the gaskets seal between the heat transfer plates. To this end, the plate heat exchanger 2 comprises a number of tightening means 16 arranged to press the first and second end plates 4 and 6, respectively, towards each other.

The design and function of gasketed plate heat exchangers are well-known and will not be described in detail herein.

The heat transfer plate 8 will now be further described with reference to FIGS. 3, 4 and 5 which illustrate the complete heat transfer plate and cross sections of the heat transfer plate. The heat transfer plate 8 is an essentially rectangular sheet of stainless steel pressed, in a conventional manner, in a pressing tool, to be given a desired structure. It defines a top plane T, a bottom plane B and a center plane C (see also FIG. 2) which are parallel to each other and to the figure plane of FIG. 3. The center plane C extends half way between the top and bottom planes, T and B, respectively. Further, the heat transfer plate has a longitudinal centre axis l and a transverse centre axis t dividing the heat transfer plate 8 into upper right and left quarters a and b, and lower right and left quarters c and d.

The heat transfer plate 8 comprises a first end area 18, a second end area 20 and a heat transfer area 22 arranged there between. In turn, the first end area 18 comprises an inlet port hole 24 for the first fluid and an outlet port hole 26 for the second fluid arranged for communication with the inlet 12 for the first fluid and the outlet for the second fluid, respectively, of the plate heat exchanger 2. Further, the first end area 18 comprises a first distribution area 28 provided with a distribution pattern in the form of a so-called chocolate pattern. Similarly, in turn, the second end area 20 comprises an outlet port hole 30 for the first fluid and an inlet port hole 32 for the second fluid arranged for communication with the outlet 14 of the first fluid and the inlet of the second fluid, respectively, of the plate heat exchanger 2. Further, the second end area 20 comprises a second distribution area 34 provided with a distribution pattern in the form of a so-called chocolate pattern. The structures of the first and second end areas are the same but mirror inverted with respect to the transverse centre axis t.

The heat transfer plate 8 further comprises an outer edge portion 35 extending around the first and second end areas 18 and 20, respectively, and the heat transfer area 22. The outer edge portion 35 comprises corrugations extending between and in the top and bottom planes T and B to define edge ridges 37 and edge valleys 39. The heat transfer plate 8 further comprises a gasket groove 41 arranged to receive a gasket. Along two opposing long sides 43 and 45 of the heat transfer area 22 the gasket groove 41 borders on, or limits, the heat transfer area 22 and extends between the heat transfer area 22 and the outer edge portion 35. The design of gasket grooves of gasketed plate heat exchangers is well-known and will not be described in detail herein.

The heat transfer area 22 is provided with a heat transfer pattern in the form of a so-called herringbone pattern. It comprises alternately arranged straight elongate heat transfer ridges 36 and heat transfer valleys 38, hereinafter also referred to just ridges and valleys, in relation to the center plane C which defines the transition between the ridges and valleys. The ridges and valleys 36 and 38 extend obliquely in relation to the transverse centre axis t and form V-shaped corrugations, the apices of which are arranged along the longitudinal centre axis l of the heat transfer plate 8. With reference to FIGS. 4 and 5, a respective top portion 40 of the ridges 36 extends in the top plane T, while a respective bottom portion 42 of the valleys 38 extends in the bottom plane B. The heat transfer area 22 adjoins the first and second distribution areas 28 and 34, respectively, along upper and lower borderlines 44 and 46, respectively (FIG. 3).

Figure 6A:
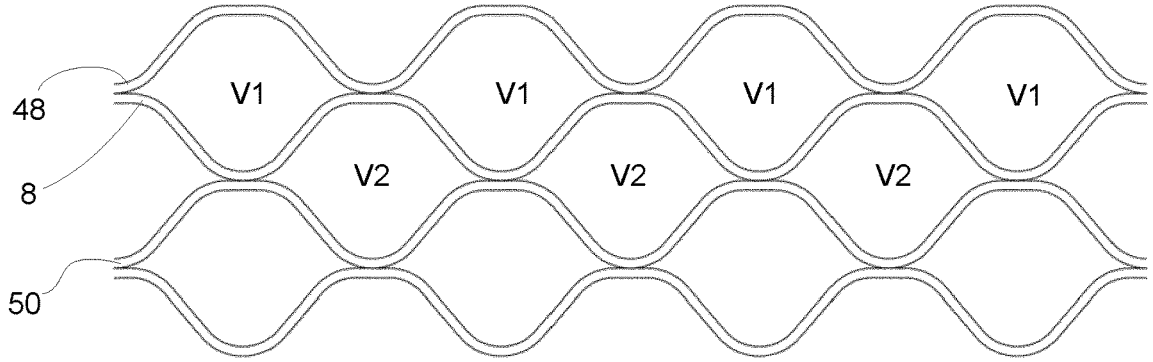
Figure 6B:
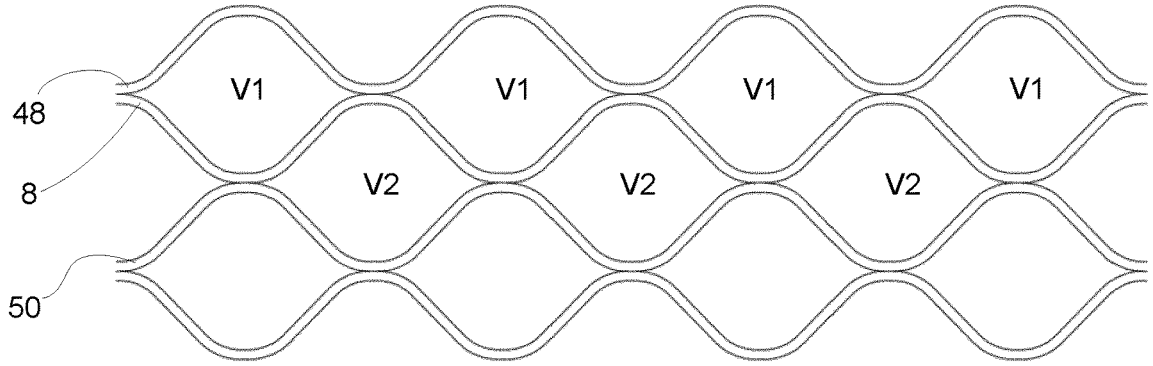

As will be further discussed below, in the plate heat exchanger 2 the heat transfer plate 8 is arranged to be positioned between a first heat transfer plate 48 and a second heat transfer plate 50, as is illustrated in FIGS. 6*a* and 6*b*. Arranged like that, the corrugated outer edge portion 35 of the heat transfer plate 8 will abut the corrugated outer edge portions of heat transfer plates 48 and 50. Further, the heat transfer pattern of the heat transfer plate 8 will cross the heat transfer patterns of the heat transfer plates 48 and 50, as is schematically illustrated, for an upper left portion of the heat transfer area 22 of the heat transfer plate 8, in FIG. 8. More particularly, since the plates are "rotated" in relation to each other, the ridges 36 (illustrated by thicker solid lines) of the heat transfer plate 8 will, in ridge contact areas 52 (some of which are illustrated by circles drown with thicker lines), cross and abut the valleys (illustrated by thinner dashed lines) of the first heat transfer plate 48. Further, the valleys 38 (illustrated by thinner solid lines) of the heat transfer plate 8 will, in valley contact areas 54 (some of which are illustrated by circles drown with thinner lines), cross and abut the ridges (illustrated by thicker dashed lines) of the second heat transfer plate 50.

Figure 4:
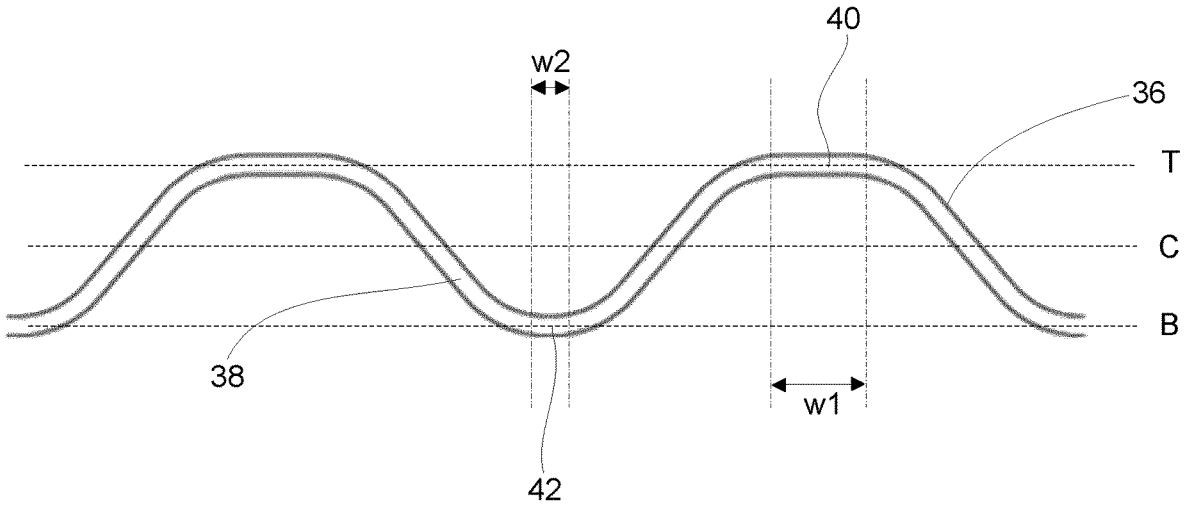
Figure 5:
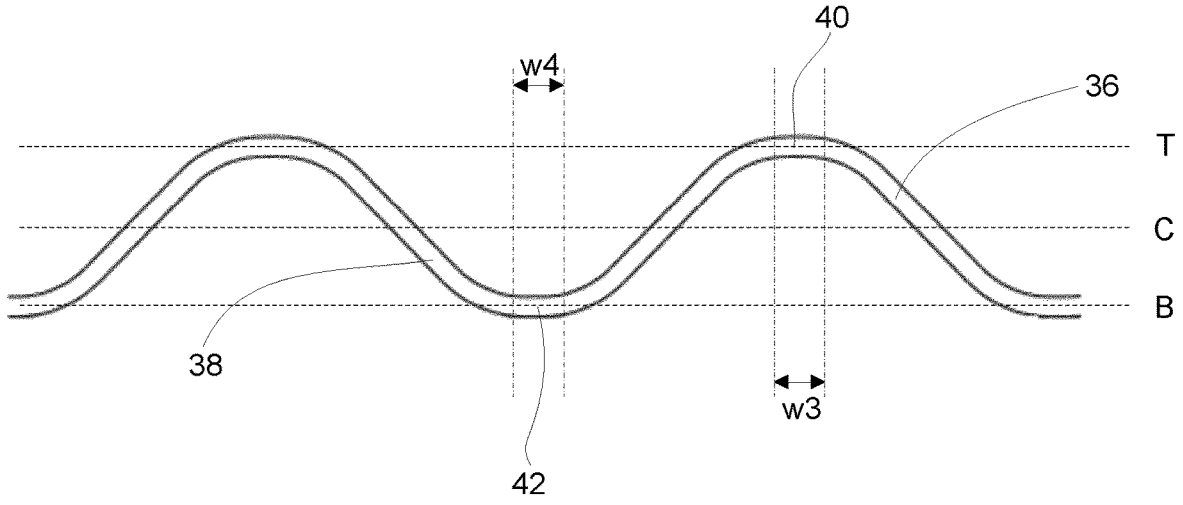

All the ridges and valleys 36 and 38, except for the ridges and valleys extending from the upper and lower borderlines 44 and 46, have essentially constant cross sections along their lengths, which cross sections are illustrated in FIG. 4. In these cross sections, the top portions 40 of the ridges 36 have a first width w1, while the bottom portions 42 of the valleys 38 have a second width w2, a width of the top and bottom portions 40 and 42 being measured perpendicular to a longitudinal extension of the ridges and valleys 36 and 38. w1 is larger than w2, meaning that the top portions 40 are wider than the bottom portions 42.

The heat transfer ridges 36 and the heat transfer valleys 38 extending from the upper and lower borderlines 44 and 46 have cross sections varying along their lengths. The ridges and valleys 36 and 38 extending from the upper and lower borderlines 44 and 46 have cross sections as illustrated in FIG. 5 within upper and lower strips 56 and 58, respectively, of the heat transfer area 22 (FIG. 3), i.e. within a respective end portion 36' and 38' extending from the upper and lower borderlines 44 and 46 (illustrated in FIG. 8 for the upper borderline 44). The upper strip 56 extends along and immediately adjacent the upper borderline 44 with a uniform width, while the lower strip 58 extends along and immediately adjacent the lower borderline 46 with the same uniform width, as is illustrated, for the upper strip 56, by the dashed line extending parallel to the upper borderline 44, in FIG. 8. Within the upper and lower strips 56 and 58, the top portions 40 of the ridges 36 have a third width w3 and the bottom portions 42 of the valleys 38 have a fourth width w4, w3<w1 and w2<w4. Here w3=w4 which means that the top portions and bottom portions are of equal width within the upper and lower strips 56 and 58. Further, within the upper and lower strips 56 and 58, the ridges 36 and the valleys 38 are symmetrical with respect to the center axis C. Thus, within the upper and lower strips 56 and 58, the ridges and valleys 36 and 38 have a locally decreased top portion width and a locally increased bottom portion width, respectively. Outside the upper and lower strips 56 and 58, the ridges and valleys 36 and 38 extending from the upper and lower borderlines 44 and 46 have cross sections as illustrated in FIG. 4, i.e. a top portion width which exceeds the bottom portion width.

Accordingly, the upper and lower strips 56 and 58 of the heat transfer area 22 are provided with a symmetric heat transfer pattern while the rest of the heat transfer area is provided with a general asymmetric heat transfer pattern.

Figure 3:
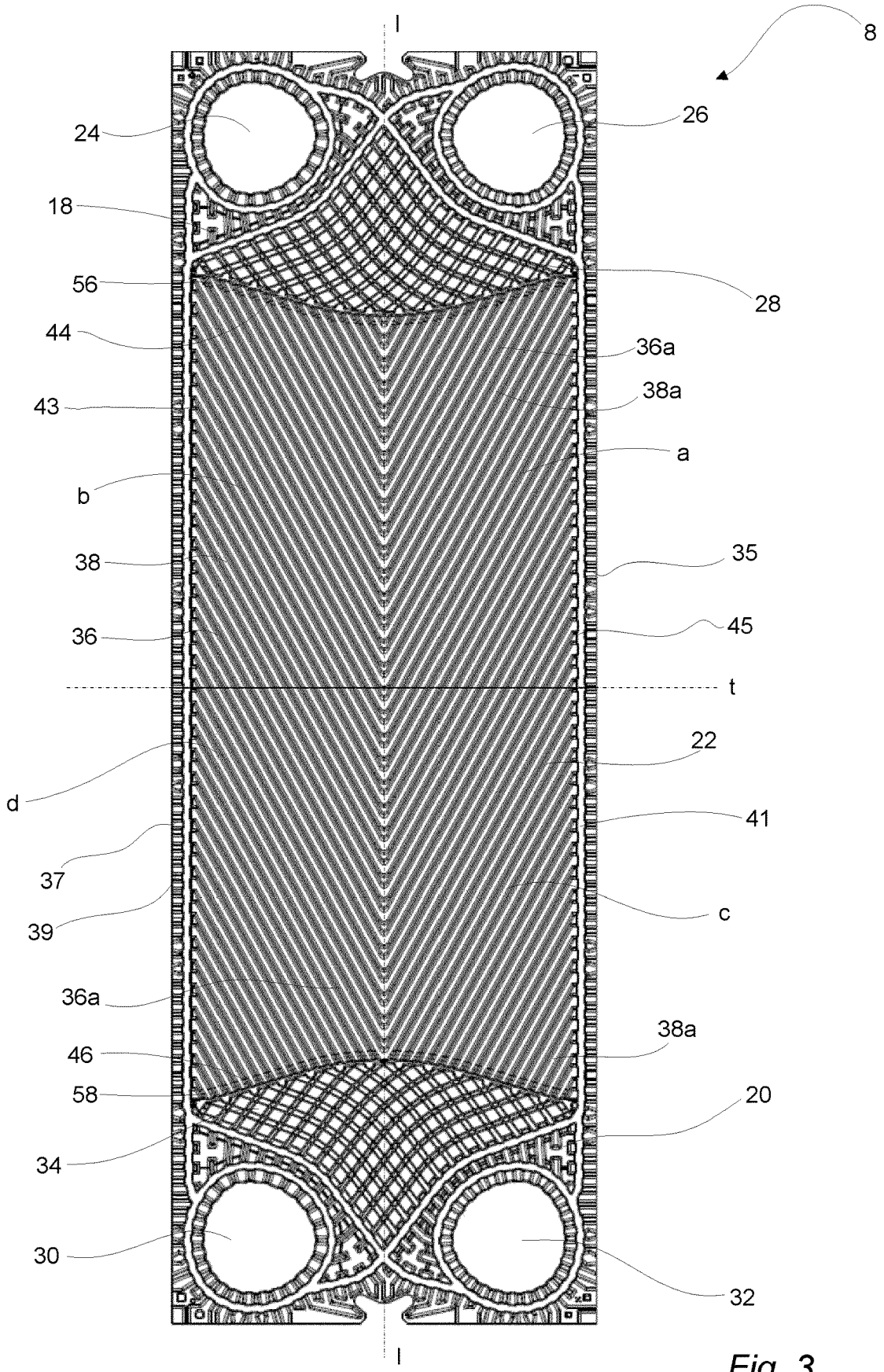
FIG. 3 is a schematic plan view of a heat transfer plate according to the invention, FIG. 4 schematically illustrates a general cross section of a heat transfer pattern of the heat transfer plate of FIG. 3, FIG. 5 schematically illustrates a local cross section of a heat transfer pattern of the heat transfer plate of FIG. 3, FIG. 6*a* schematically illustrates channels formed between heat transfer plates according to the invention, within a larger heat transfer area portion, when stacked in a first way, FIG. 6*b* schematically illustrates channels formed between heat transfer plates according to the invention, within a smaller heat transfer area portion, when stacked in the first way, FIG. 7*a* schematically illustrates channels formed between heat transfer plates according to the invention, within a larger heat transfer area portion, when stacked in a second way, FIG. 7*b* schematically illustrates channels formed between heat transfer plates according to the invention, within a smaller heat transfer area portion, when stacked in the second way, FIG. 8 schematically illustrates locations of ridge and valley contact areas when the heat transfer plate of FIG. 3 is arranged between two other heat transfer plates according to FIG. 3 in a plate pack, and FIG. 9 schematically illustrates locations of first ridge and valley contact areas of the heat transfer plate of FIG. 3.
Figure 8:
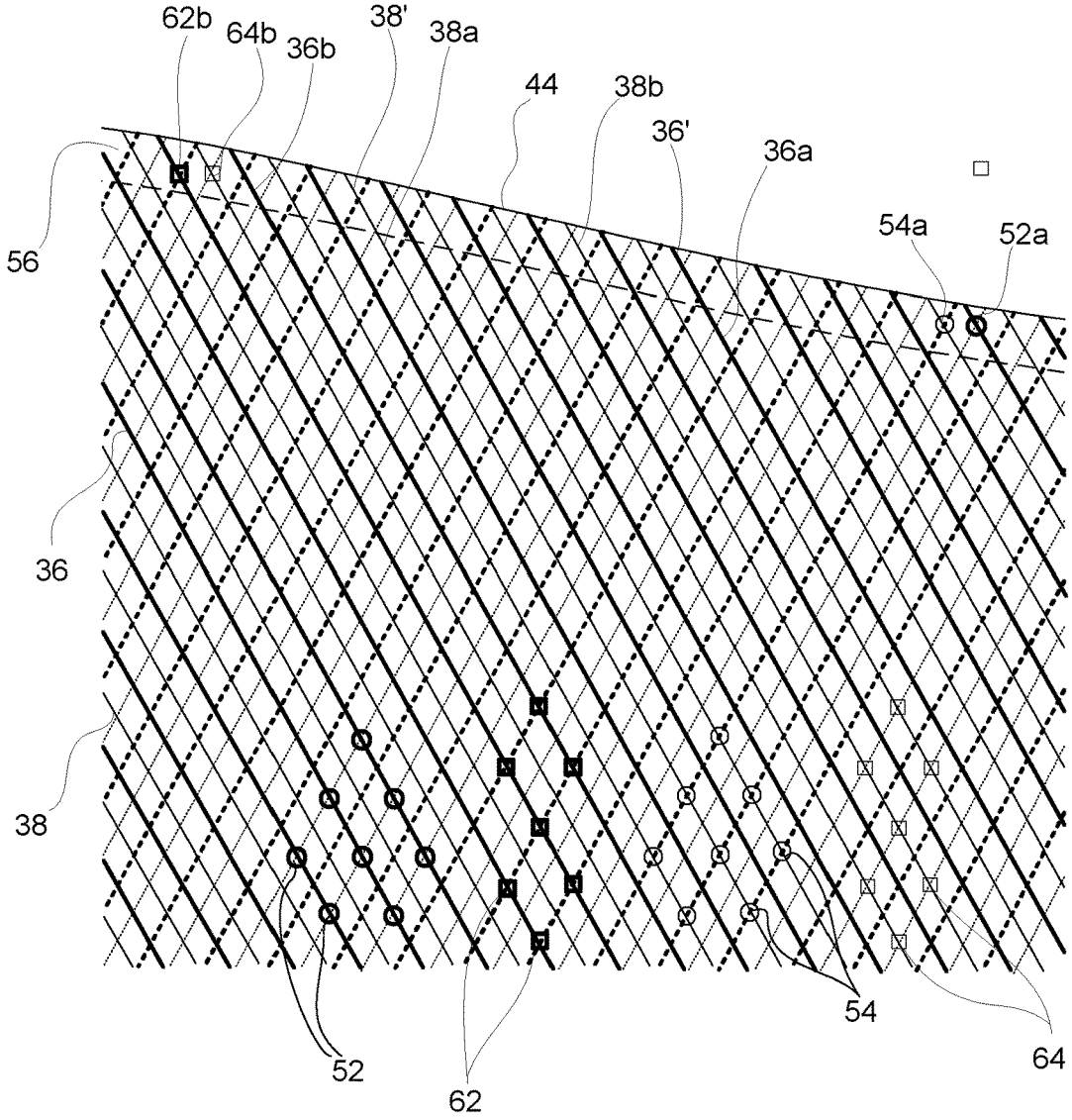

With reference to FIGS. 3 and 8, at least some (here, all but possibly the outermost ones) of the heat transfer ridges 36 extending from the upper and lower borderlines 44 and 46 comprise a ridge contact area 52 arranged within the upper and lower strips 56 and 58. Herein, these heat transfer ridges and ridge contact areas are referred to as first heat transfer ridges or just first ridges 36*a*, and first ridge contact areas 52*a*. Similarly, at least some (here, all but possibly the outermost ones) of the heat transfer valleys 38 extending from the upper and lower borderlines 44 and 46 comprise a valley contact area 54 arranged within the upper and lower strips 56 and 58. Herein, these heat transfer valleys and valley contact areas are referred to as first heat transfer valleys or just first valleys 38*a*, and first valley contact areas 54*a*.

As is clear from the figures, the upper and lower borderlines 44 and 46 defining the extension of the first and second distribution areas 28 and 34 and the heat transfer area 22 are curved and outwards bulging towards the transverse center axis t of the heat transfer plate 8 to improve the strength and the flow distribution capacity of the heat transfer plate 8. Because of this borderline curvature, the distance between adjacent ridge and valley contact areas 52 and 54 close to the upper and lower border lines 44 and 46 may be longer than if the upper and lower border lines instead had been straight. A longer distance between adjacent contact areas may result in an increased risk of plate deformation when the heat transfer plate 8 is arranged between the first and second heat transfer plates 48 and 50 in the plate pack 10 in the plate heat exchanger 2, especially during operation of the heat exchanger. Further, another factor that may increase the risk of plate deformation is an asymmetric heat transfer pattern comprising ridges and valley having top and bottom portions, respectively, of different widths. With such an asymmetric heat transfer pattern, the deformation risk is the highest when the heat transfer plates are "rotated" in relation to each other in the plate pack in which case the ridge top portions and valley bottom portions of one heat transfer plate abut the valley bottom portions and ride top portions of the adjacent heat transfer plates. According to the present invention the difference between the ridge top portion width and valley bottom portion width is reduced, or even erased, locally, close to the upper and lower borderlines where the risk of plate deformation is the highest, which reduces the risk of plate deformation. Thereby, the strength of the heat transfer plate is improved while the heat transfer plate maintains its asymmetric properties across most of the heat transfer area, and its overall asymmetric characteristics. The upper and lower strips within which the heat transfer pattern is locally changed are made sufficiently wide to comprise at least one ridge contact area for at least a majority of the ridges extending from the upper and lower borderlines, and at least one valley contact area for at least a majority of the valleys extending from the upper and lower borderlines. At the same time, the upper and lower strips within which the heat transfer pattern is locally changed are made narrow enough so as to have an insignificant effect on the asymmetric characteristics of the heat transfer pattern.

Figure 9:
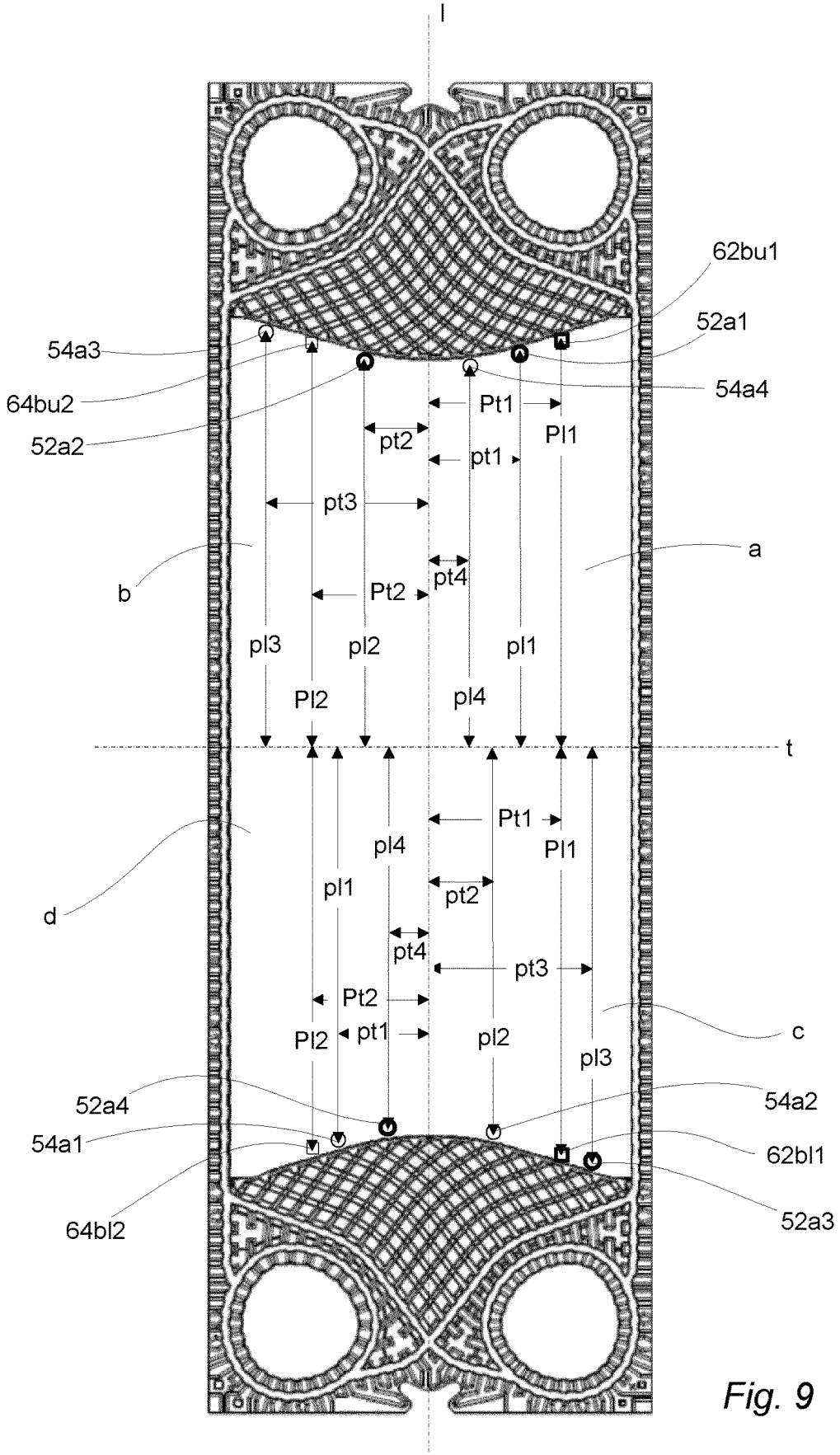

In the plate pack 10 of the heat exchanger 2, the first and second heat transfer plates 48 and 50 are arranged "rotated" in relation to the heat transfer plate 8. Consequently, the ridges 36 within the upper right and left quarters a and b, and the lower right and left quarters c and d, of the heat transfer plate 8 abut, within the ridge contact areas 52, the valleys within the lower left and right quarters and the upper left and right quarters, respectively, within the valley contact areas, of the heat transfer plate 48. Further, the valleys 38 within the upper right and left quarters a and b, and the lower right and left quarters c and d, of the heat transfer plate 8 abut, within the valley contact areas 54, the ridges within the lower left and right quarters and the upper left and right quarters, respectively, within the ridge contact areas, of the heat transfer plate 50. In the plate pack 10, the upper strip 56 of the plate 8 is arranged between the lower strips of the plates 48 and 50, while the lower strip 58 of the plate 8 is arranged between the upper strips of the plates 48 and 50. The plate portions of locally changed cross section should abut each other, i.e. the first ridge and valley contact areas of the heat transfer plate 8 should abut the first valley and ridge contact areas of the heat transfer plates 48 and 50. To this end, since the plates 8, 48 and 50 look the same, with respect to the longitudinal and transverse center axes l, t, an absolute position of the first ridge contact areas 52*a* within the upper right quarter a, upper left quarter b, lower right quarter c, and lower left quarter d, respectively, of the heat transfer plate 8, is at least partly overlapping with an absolute position of the first valley contact areas 54*a* arranged within the lower left quarter d, lower right quarter c, upper left quarter b and upper right quarter a, respectively, of the heat transfer plate 8. This is illustrated in FIG. 9 for first ridge contact areas 52*a*1, 52*a*2, 52*a*3 and 52*a*4 which are arranged on the same distances (pt1, pl1), (pt2, pl2), (pt3, pl3) and (pt4, pl4) from the longitudinal and transverse center axes l and t as first valley contact areas 54*a*1, 54*a*2, 54*a*3 and 54*a*4.

FIGS. 6*a* and 6*b* illustrate what it looks like inside the plate pack 10 of the plate heat exchanger 2 within (FIG. 6*b*) and outside of (FIG. 6*a*) the upper and lower strips of the heat transfer areas of the heat transfer plates 8, 48 and 50. It should be said that FIGS. 6*a* and 6*b* are simplified for reasons of clarity and do not depict true cross sections of the plate pack, since the ridges and valleys of different plates extend obliquely in relation to each other and not in parallel as is indicated by the figures. As previously said, within the heat transfer area 22, the top portions 40 of the ridges 36 and the bottom portions 42 of the valleys 38 of the plate 8 abut the bottom portion of the valleys and the top portion of the ridges of the plates 48 and 50, respectively. With reference to FIG. 6*a*, outside the upper and lower strips, the top portion of the ridges of the plates are wider than the bottom portion of the valleys of the plates. With reference to FIG. 6*b*, within the upper and lower strips, the top portion of the ridges of the plates and the bottom portion of the valleys of the plates are equally wide so as to reduce the risk of plate deformation where it is most likely to occur. The plates 8 and 48 form a channel of volume V1 and the plates 8 and 50 form a channel of volume V2, wherein V1 equals V2.

Figure 7A:
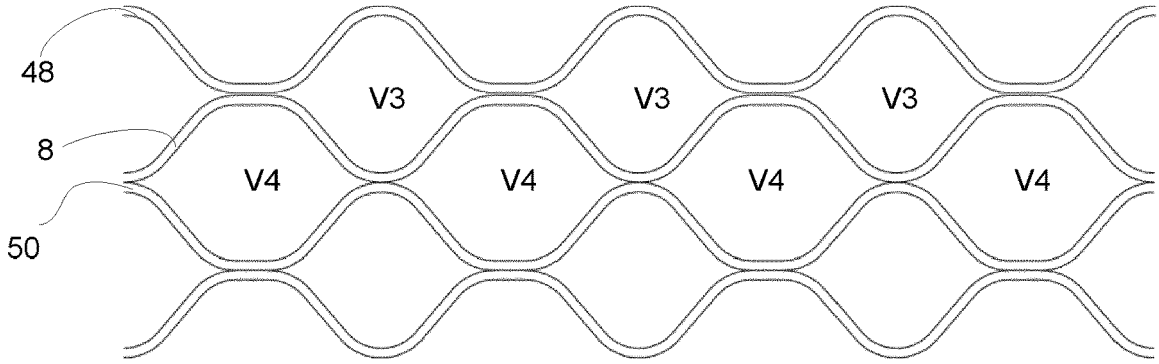
Figure 7B:
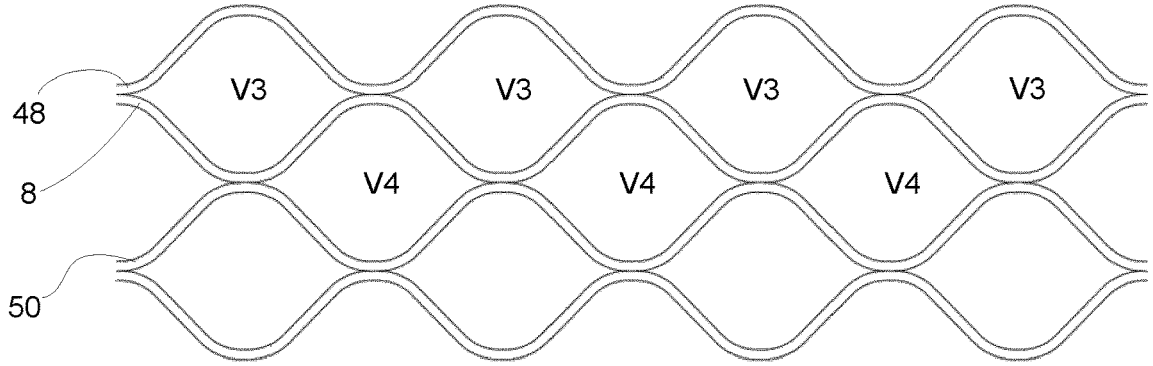

Instead of being "rotated" in relation to each other, the plates in the plate pack can be "flipped" in relation to each other, as is illustrated in FIGS. 7*a* and 7*b*. Arranged like that, the heat transfer pattern of the heat transfer plate 8 will cross the heat transfer patterns of the heat transfer plates 48 and 50, as is schematically illustrated, for an upper left portion of the heat transfer area 22 of the heat transfer plate 8, in FIG. 8. More particularly, since the plates are "flipped" in relation to each other, the ridges 36 (illustrated by thicker solid lines) of the heat transfer plate 8 will, in ridge contact areas 62 (some of which are illustrated by squares drown with thicker lines), cross and abut the ridges (illustrated by thicker dashed lines) of the first heat transfer plate 48. Further, the valleys 38 (illustrated by thinner solid lines) of the heat transfer plate 8 will, in valley contact areas 64 (some of which are illustrated by squares drown with thinner lines), cross and abut the valleys (illustrated by thinner dashed lines) of the second heat transfer plate 50.

Clearly, the location of the ridge contact areas and valley contact areas of the heat transfer plate 8 is dependent on whether the heat transfer plate is arranged to be "rotated" or "flipped" in relation to the other plates in a plate pack.

With reference to FIGS. 3 and 8, at least some (here, all but possibly the outermost ones) of the heat transfer ridges 36 extending from the upper and lower borderlines 44 and 46 comprise a ridge contact area 62 arranged within the upper and lower strips 56 and 58. Herein, these heat transfer ridges and ridge contact areas are referred to as first heat transfer ridges or just first ridges 36*b*, and first ridge contact areas 62*b*. Similarly, at least some (here, all but possibly the outermost ones) of the heat transfer valleys 38 extending from the upper and lower borderlines 44 and 46 comprise a valley contact area 64 arranged within the upper and lower strips 56 and 58. Herein, these heat transfer valleys and valley contact areas are referred to as first heat transfer valleys or just first valleys 38*b*, and first valley contact areas 64*b*.

As previously said, if the first and second heat transfer plates 48 and 50 are arranged "flipped" in relation to the heat transfer plate 8, the ridges 36 of the heat transfer plate 8 abut, within the ridge contact areas 62, the ridges, within the ridge contact areas, of the heat transfer plate 48. Further, the valleys 38 of the heat transfer plate 8 abut, within the valley contact areas 64, the valleys, within the valley contact areas, of the heat transfer plate 50. The upper strip 56 of the plate 8 is arranged between the lower strips of the plates 48 and 50, while the lower strip 58 of the plate 8 is arranged between the upper strips of the plates 48 and 50. The plate portions of locally changed cross section should abut each other, i.e. the first ridge and valley contact areas of the heat transfer plate 8 should abut the first ridge and valley contact areas of the heat transfer plates 48 and 50. To this end, since the plates 8, 48 and 50 look the same, a mirroring, across the transverse center axis t of the heat transfer plate 8, of a position of the first valley contact areas 64*b* arranged within an upper half, i.e. the upper left and right quarters a and b, of the heat transfer plate 8, is at least partly overlapping with a position of the first valley contact areas 64*b* arranged within a lower half, i.e. the lower left and right quarters c and d, of the heat transfer plate 8. Similarly, a mirroring, across the transverse center axis t of the heat transfer plate 8, of a position of the first ridge contact areas 62*b* arranged within an upper half, i.e. the upper left and right quarters a and b, of the heat transfer plate 8, is at least partly overlapping with a position of the first ridge contact areas 62*b* arranged within a lower half, i.e. the lower left and right quarters c and d, of the heat transfer plate 8.

This is illustrated in FIG. 9 for first ridge contact areas 62*bu*1 and 62*bl*1 which are arranged on the same distances (Pt1, Pl1) from the longitudinal and transverse center axes l and t, and first valley contact areas 64*bu*2 and 64*bl*2 which are arranged on the same distances (Pt2, Pl2) from the longitudinal and transverse center axes l and t.

FIGS. 7*a* and 7*b* illustrate what it looks like inside a plate pack in which the plates are "flipped" instead of "rotated" in relation to each other, within (FIG. 7*b*) and outside of (FIG. 7*a*) the upper and lower strips of the heat transfer areas of the heat transfer plates 8, 48 and 50. Just like FIGS. 6*a* and 6*b*, FIGS. 7*a* and 7*b* are simplified for reasons of clarity and do not depict true cross sections of the plate pack. As previously said, within the heat transfer area 22, the top portions 40 of the ridges 36 and the bottom portions 42 of the valleys 38 of the plate 8 abut the top portion of the ridges and the bottom portion of the valleys of the plates 48 and 50, respectively. With reference to FIG. 7*a*, outside the upper and lower strips, the top portion of the ridges of the plates are wider than the bottom portion of the valleys of the plates. With reference to FIG. 7*b*, within the upper and lower strips, the top portion of the ridges of the plates the bottom portion of the valleys of the plates are equally wide. The plates 8 and 48 form a channel of volume V3 and the plates 8 and 50 form a channel of volume V4, wherein V3<V4.

Thus, the heat transfer plate 8 has one set of ridge and valley contact areas 52 and 54 for "rotation" arrangement and one set of ridge and valley contact areas 62 and 64 for "flipping" arrangement. The upper and lower strips 56 and 58 are preferably made wide enough such that at least some (here, all but possibly the outermost ones) of the heat transfer ridges 36 extending from the upper and lower borderlines 44 and 46 comprise a ridge contact area 52 and a ridge contact area 62 arranged within the upper and lower strips 56 and 58. These heat transfer ridges are then first ridges 36*a* as well as first ridges 36*b*. Similarly, the upper and lower strips 56 and 58 are preferably made wide enough such at least some (here, all but possibly the outermost ones) of the heat transfer valleys 38 extending from the upper and lower borderlines 44 and 46 comprise a valley contact area 54 and a valley contact area 64 arranged within the upper and lower strips 56 and 58. These heat transfer valleys are then first valleys 38*a* as well as first valleys 38*b*. At the same time the upper and lower strips 56 and 58 are made as narrow as possible so as to maintain the asymmetric characteristics of the heat transfer plate to the greatest extent possible.

The heat transfer plate 8 comprises a heat transfer area 22 provided with a heat transfer pattern of alternately arranged ridges 36 and valleys 38. Outside the upper and lower strips 56 and 58 of the heat transfer area, the heat transfer pattern is asymmetric in that the top portions 40 of the ridges 36 are wider than the bottom portions 42 of the valleys 38. Within the upper and lower strips the width of the top portions of the ridges is decreased, while the width of the bottom portions of the valleys is increased, to give the top and bottom portions an equal width and make the heat transfer pattern locally symmetric. In alternative embodiments, the top and bottom portion widths within the upper and lower strips need not be equal but may only differ less than outside the upper and lower strips. The top portion width may even be larger than the bottom portion width outside the upper and lower strips, and smaller than the bottom portion width within the upper and lower strips. Further, instead of changing both the top portion width and the bottom portion width within the upper and lower strips 56 and 58, only one of them could be changed. As an example, within the upper and lower strips, the width of the bottom portions of the valleys could be increased while the width of the top portions of the ridges could be maintained. Alternatively, within the upper and lower strips, the width of the top portions of the ridges could be decreased while the width of the bottom portions of the valleys could be maintained. Also here, the top portion width and the bottom portion width, could, but need not, be equal within the upper and lower strips. Further, in case of equal top and bottom portion widths, with reference to a cross section through, and perpendicular to the longitudinal extension of, the heat transfer ridges and heat transfer valleys, also here the ridges and valleys could be symmetrical with reference to the center plane within the upper and lower strips.

The above described embodiment of the present invention should only be seen as examples. A person skilled in the art realizes that the embodiments discussed can be varied and combined in a number of ways without deviating from the inventive conception.

As an example, the upper and lower strips within which the heat transfer pattern is locally changed, need not be of uniform width along their extension and/or need not be continuous but could be intermittent. Accordingly, not all heat transfer ridges and heat transfer valleys extending from the upper and lower borderlines must have a locally changed cross section.

Further, the upper and lower strips within which the heat transfer pattern is locally changed need not border on, but could be separated from, the upper and lower borderlines along part of, or their complete, extension.

Further, the heat transfer pattern need not even be locally changed close to the upper and lower borderlines but could instead be changed somewhere else within the heat transfer area, for example along the longitudinal center axis of the heat transfer plate, close to the apices of the V-shaped corrugations of the heat transfer pattern or close to longitudinal edges of the heat transfer area.

The above specified distribution pattern of chocolate type and heat transfer pattern of herring bone type are just exemplary. Naturally, the invention is applicable in connection with other types of patterns. For example, the heat transfer pattern could comprise V-shaped corrugations wherein the apex of each corrugation points from one long side towards another long side of the heat transfer plate. Further, the heat transfer ridges and heat transfer valleys need not have the cross sections illustrated in the figures. As an example, the heat transfer ridges and valleys could form "shoulders" as illustrated in WO 2017/167598. It should also be said that the distribution pattern within the distribution areas may be either symmetric or asymmetric.

The above described plate heat exchanger is of parallel counter flow type, i.e. the inlet and the outlet for each fluid are arranged on the same half of the plate heat exchanger and the fluids flow in opposite directions through the channels between the heat transfer plates. Naturally, the plate heat exchanger could instead be of diagonal flow type and/or a co-flow type.

The plate heat changer above comprises one plate type only. Naturally, the plate heat exchanger could instead comprise two or more different types of alternately arranged heat transfer plates, for example two types having different heat transfer patterns, such different inclinations of the heat transfer ridges and valleys.

The heat transfer plate need not be rectangular but may have other shapes, such as essentially rectangular with rounded corners instead of right corners, circular or oval. The heat transfer plate need not be made of stainless steel but could be of other materials, such as titanium or aluminium.

The present invention could be used in connection with other types of plate heat exchangers than gasketed ones, such as all-welded, semi-welded, fusion-bonded and brazed plate heat exchangers.

The upper and lower borderlines need not be curved but could have other forms. For example, they could be straight or zig-zag shaped.

The heat transfer area of the heat transfer plate could comprise upper and lower transition bands bordering on the upper and lower border lines and being provided with a different pattern than the rest of the heat transfer area, wherein the upper and lower strips would be comprised in these upper and lower transition bands. Such transition bands could, for example, be designed like the transition areas of the heat transfer plate according to EP2728292.

It should be stressed that the attributes front, back, upper, lower, first, second, third, upper, lower, etc. is used herein just to distinguish between details and not to express any kind of orientation or mutual order between the details.

Further, it should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate for a plate heat exchanger, the heat transfer plate having a transverse center axis and comprising a first distribution area, a heat transfer area and a second distribution area arranged in succession along a longitudinal center axis of the heat transfer plate extending perpendicular to the transverse center axis of the heat transfer plate, the heat transfer area being provided with a heat transfer pattern differing from a pattern within the first and second distribution areas, the first distribution area adjoining the heat transfer area along an upper borderline, and the second distribution area adjoining the heat transfer area along a lower borderline, wherein the heat transfer pattern comprises elongate alternately arranged heat transfer ridges and heat transfer valleys extending obliquely in relation to the transverse center axis of the heat transfer plate, a respective top portion of the heat transfer ridges extending in a top plane and a respective bottom portion of the heat transfer valleys extending in a bottom plane, which top and bottom planes are parallel to each other, a center plane extending half-way between, and parallel to, the top and bottom planes defining a border between the heat transfer ridges and the heat transfer valleys, wherein the heat transfer ridges comprise ridge contact areas within which the heat transfer ridges are arranged to abut an adjacent first heat transfer plate in the plate heat exchanger, and the heat transfer valleys comprise valley contact areas within which the heat transfer valleys are arranged to abut an adjacent second heat transfer plate in the plate heat exchanger, wherein, within at least half of the heat transfer area, the top portions of the heat transfer ridges have a first width w1, and the bottom portions of the heat transfer valleys have a second width w2, a width of the top and bottom portions being measured perpendicular to a longitudinal extension of the heat transfer ridges and heat transfer valleys, and $w1 \neq w2$, at least one of w1 and w2 being constant, the top portion of a number of first heat transfer ridges of the heat transfer ridges, within a respective first ridge contact area of the ridge contact areas, having a third width w3, wherein, if $w1 > w2$ then $w3 < w1$, and, if $w1 < w2$ then $w3 > w1$, the heat transfer ridges including several heat transfer ridges in which: i) one section of the heat transfer ridge is within the at least half of the heat transfer area with the top portion having the width w1; and ii) another section of the heat transfer ridge is outside the at least half of the heat transfer area with the top portion having the width w3.

2. The heat transfer plate according to claim 1, wherein, if $w1 > w2$ then $w3 \geq w2$, and, if $w1 < w2$ then $w3 \leq w2$.

3. The heat transfer plate according to claim 1, wherein $w1 > w2$, and wherein the bottom portion of a number of first heat transfer valleys of the heat transfer valleys, within a respective first valley contact area of the valley contact areas, has a fourth width w4, and $w2 < w4$.

4. The heat transfer plate according to claim 3, wherein $w4 \leq w3$.

5. The heat transfer plate according to claim 3, wherein, with reference to a cross section through, and perpendicular to the longitudinal extension of, the heat transfer ridges and heat transfer valleys, the first heat transfer ridges, within the first ridge contact areas, and the first heat transfer valleys, within the first valley contact areas, are symmetrical with respect to said center plane.

6. The heat transfer plate according to claim 3, wherein each of the first heat transfer valleys extend from one of said upper and lower borderlines.

7. The heat transfer plate according to claim 3, wherein, for each of the first heat transfer valleys, the first valley contact area is the valley contact area arranged closest to one of said upper and lower borderlines.

8. The heat transfer plate according to claim 3, wherein the first valley contact areas are comprised in a respective end portion of the first heat transfer valleys, the respective end portion extending from one of said upper and lower borderlines and has a constant width within the bottom portion.

9. The heat transfer plate according to claim 3, wherein an absolute position, with respect to the longitudinal and transverse center axes of the heat transfer plate, of a respective one of the first ridge contact areas arranged within an upper right quarter, upper left quarter, lower right quarter, and lower left quarter, respectively, of the heat transfer plate, is at least partly overlapping with an absolute position, with respect to the longitudinal and transverse center axes of the heat transfer plate, of a respective one of the first valley contact areas arranged within a lower left quarter, lower right quarter, upper left quarter and upper right quarter, respectively, of the heat transfer plate.

10. The heat transfer plate according to claim 3, wherein a mirroring, across the transverse center axis of the heat transfer plate, of a position of one of the first valley contact areas arranged within an upper half of the heat transfer plate, is at least partly overlapping with a position of one of the first valley contact areas arranged within a lower half of the heat transfer plate.

11. The heat transfer plate according to claim 1, wherein a mirroring, across the transverse center axis of the heat transfer plate, of a position of one of the first ridge contact areas arranged within an upper half of the heat transfer plate, is at least partly overlapping with a position of one of the first ridge contact areas arranged within a lower half of the heat transfer plate.

12. The heat transfer plate according to claim 1, wherein each of the first heat transfer ridges extends from one of said upper and lower borderlines.

13. The heat transfer plate according to claim 1, wherein, for each of the first heat transfer ridges, the first ridge contact area is the ridge contact area arranged closest to said one of said upper and lower borderlines.

14. The heat transfer plate according to claim 1, wherein the first ridge contact areas are comprised in a respective end portion of the first heat transfer ridges, which end portion extends from one of said upper and lower borderlines and has a constant width within the top portion.

15. The heat transfer plate according to claim 1, wherein the upper and lower borderlines are non-straight.

16. A heat transfer plate for a plate heat exchanger, the heat transfer plate having a transverse center axis and comprising a first distribution area, a heat transfer area and a second distribution area arranged in succession along a longitudinal center axis of the heat transfer plate extending perpendicular to the transverse center axis of the heat transfer plate, the heat transfer area being provided with a heat transfer pattern differing from a pattern within the first and second distribution areas, the first distribution area adjoining the heat transfer area along an upper borderline, and the second distribution area adjoining the heat transfer area along a lower borderline, wherein the heat transfer pattern comprises elongate alternately arranged heat transfer ridges and heat transfer valleys extending obliquely in relation to the transverse center axis of the heat transfer plate, a respective top portion of the heat transfer ridges extending in a top plane and a respective bottom portion of the heat transfer valleys extending in a bottom plane, which top and bottom planes are parallel to each other, a center plane extending half-way between, and parallel to, the top and bottom planes defining a border between the heat transfer ridges and the heat transfer valleys, wherein the heat transfer ridges comprise ridge contact areas within which the heat transfer ridges are arranged to abut an adjacent first heat transfer plate in the plate heat exchanger, and the heat transfer valleys comprise valley contact areas within which the heat transfer valleys are arranged to abut an adjacent second heat transfer plate in the plate heat exchanger, wherein, within at least half of the heat transfer area, the top portions of the heat transfer ridges have a first width $w1$, and the bottom portions of the heat transfer valleys have a second width $w2$, a width of the top and bottom portions being measured perpendicular to a longitudinal extension of the heat transfer ridges and heat transfer valleys, and $w1 \neq w2$, the top portion of a number of first heat transfer ridges of the heat transfer ridges, within a respective first ridge contact area of the ridge contact areas, having a third width $w3$, wherein, if $w1>w2$ then $w3<w1$, and, if $w1<w2$ then $w3>w1$, wherein the first ridge contact areas are comprised in a respective end portion of the first heat transfer ridges, which end portion extends from one of said upper and lower borderlines, the heat transfer ridges including several heat transfer ridges whose top portions each have: i) one section having the width $w1$; and ii) another section having the width $w3$.

17. The heat transfer plate according to claim 16, wherein, if $w1>w2$ then $w3 \geq w2$, and, if $w1<w2$ then $w3 \leq w2$.

18. The heat transfer plate according to claim 16, wherein $w1>w2$, and wherein the bottom portion of a number of first heat transfer valleys of the heat transfer valleys, within a respective first valley contact area of the valley contact areas, has a fourth width $w4$, and $w2 \leq w4$.

19. A heat transfer plate for a plate heat exchanger, the heat transfer plate having a transverse center axis and comprising a first distribution area, a heat transfer area and a second distribution area arranged in succession along a longitudinal center axis of the heat transfer plate extending perpendicular to the transverse center axis of the heat transfer plate, the heat transfer area being provided with a heat transfer pattern differing from a pattern within the first and second distribution areas, the first distribution area adjoining the heat transfer area along an upper borderline, and the second distribution area adjoining the heat transfer area along a lower borderline, wherein the heat transfer pattern comprises elongate alternately arranged heat transfer ridges and heat transfer valleys extending obliquely in relation to the transverse center axis of the heat transfer plate, a respective top portion of the heat transfer ridges extending in a top plane and a respective bottom portion of the heat transfer valleys extending in a bottom plane, which top and bottom planes are parallel to each other, a center plane extending half-way between, and parallel to, the top and bottom planes defining a border between the heat transfer ridges and the heat transfer valleys, wherein the heat transfer ridges comprise ridge contact areas within which the heat transfer ridges are arranged to abut an adjacent first heat transfer plate in the plate heat exchanger, and the heat transfer valleys comprise valley contact areas within which the heat transfer valleys are arranged to abut an adjacent second heat transfer plate in the plate heat exchanger, wherein, within at least half of the heat transfer area, the top portions of the heat transfer ridges have a first width w1, and the bottom portions of the heat transfer valleys have a second width w2, a width of the top and bottom portions being measured perpendicular to a longitudinal extension of the heat transfer ridges and heat transfer valleys, and w1≠w2, the top portion of a number of first heat transfer ridges of the heat transfer ridges, within a respective first ridge contact area of the ridge contact areas, having a third width w3, wherein, if w1>w2 then w3<w1, and, if w1<w2 then w3>w1, the first heat transfer ridges in which the top has the third width w3 extend from one of said upper and lower borderlines, several of the heat transfer ridges having the top portions within the at least half of the heat transfer area and possessing the width w1 also including a section outside the at least half of the heat transfer area and possessing the width w3.

20. The heat transfer plate according to claim 19, wherein w1 and w2 are constant.

* * * * *